US010786026B1

(12) United States Patent
Jhin et al.

(10) Patent No.: US 10,786,026 B1
(45) Date of Patent: Sep. 29, 2020

(54) SYNTHETIC BRAIDING HAIR OF DIFFERING LENGTHS PACKAGED WITH A CARDIOID

(71) Applicant: JBS Hair Inc., Doraville, GA (US)

(72) Inventors: Eddie K Jhin, Duluth, GA (US); Jae Hoon Lee, Suwanee, GA (US)

(73) Assignee: JBS Hair Inc., Doraville, GA (US)

( * ) Notice: Subject to any disclaimer, the term of this patent is extended or adjusted under 35 U.S.C. 154(b) by 424 days.

(21) Appl. No.: 15/380,324

(22) Filed: Dec. 15, 2016

(51) Int. Cl.
*A41G 5/00* (2006.01)

(52) U.S. Cl.
CPC ..... *A41G 5/006* (2013.01); *A41G 5/0046* (2013.01)

(58) Field of Classification Search
CPC ..... A41G 5/006; A41G 5/0046
USPC ..... 132/201, 53, 54, 55, 56
See application file for complete search history.

(56) References Cited

U.S. PATENT DOCUMENTS 578,623 A * 3/1897 Borden ..... A41G 3/00 132/53
3,557,806 A 1/1971 Blanchard
5,497,795 A 3/1996 Hibbard
5,775,343 A 7/1998 Zam
6,035,861 A 3/2000 Copello
6,135,122 A 10/2000 Campbell et al.
6,159,598 A 12/2000 Ishimura
D440,715 S 4/2001 Sartena
D488,587 S 4/2004 Puorro
7,047,571 B1 5/2006 Kelly
D561,938 S 2/2008 Madden
D642,744 S 8/2011 Hunt-Larder
D668,818 S 10/2012 Jones
D675,402 S 2/2013 King
D685,135 S 6/2013 Jazwinski et al.
D703,385 S 4/2014 Adams
D704,893 S 5/2014 Dierker
D766,550 S 9/2016 Coggins et al.
10,080,396 B2 9/2018 Adjesson
D829,997 S 10/2018 Johnson
10,160,584 B2 12/2018 Yi
2004/0168699 A1 9/2004 Park
(Continued)

FOREIGN PATENT DOCUMENTS

OA 9811 4/1994

OTHER PUBLICATIONS

Double Weft 100% Remy Human Hair Clip in Extensions 14"-22" Grade 7A Quality Full Head Thick Long Soft Silky Straight 8pcs 18 clips for Women Fashion (22".22 inch 160g, 2 dark brown); by MY_LADY; Reviewed on Amazon.com Jul. 24, 2016.
(Continued)

*Primary Examiner* — Nicholas D Lucchesi
(74) *Attorney, Agent, or Firm* — Philip H. Burrus, IV

(57) ABSTRACT

A hair accessory includes bundled synthetic braiding hair. The bundled synthetic braiding hair can include a first bundle of synthetic hair stands having a first length, a second bundle of synthetic hair strands having a second length that is shorter than the first length. Other bundles with different lengths can be included as well. A binder can be coupled about a waist of the bundled synthetic braiding hair. When the bundled synthetic braiding hair is folded about the binder, the different strand lengths work to define a substantially cardioid shaped perimeter of the bundled synthetic braiding hair.

20 Claims, 7 Drawing Sheets

(56) References Cited

U.S. PATENT DOCUMENTS

| | | | | |
|---|---|---|---|---|
| 2005/0268929 | A1* | 12/2005 | Frazier | A41G 5/004 132/53 |
| 2006/0191550 | A1* | 8/2006 | Frazier | A41G 5/006 132/53 |
| 2008/0163882 | A1 | 7/2008 | Owens et al. | |
| 2009/0014023 | A1* | 1/2009 | Waters | A41G 5/0066 132/201 |
| 2009/0260649 | A1 | 10/2009 | Sakurai et al. | |
| 2009/0272396 | A1* | 11/2009 | Tochioka | A41G 5/0046 132/201 |
| 2010/0037907 | A1 | 2/2010 | Sugai et al. | |
| 2010/0154815 | A1* | 6/2010 | Chang | A41G 5/0066 132/201 |
| 2011/0271976 | A1 | 11/2011 | Sasayama | |
| 2012/0145174 | A1* | 6/2012 | Frazier | A41G 5/006 132/201 |
| 2012/0298127 | A1* | 11/2012 | Yi | A41G 5/0066 132/201 |
| 2013/0098380 | A1* | 4/2013 | Kim | A41G 5/006 132/53 |
| 2014/0191634 | A1 | 7/2014 | Smiley | |
| 2015/0189936 | A1* | 7/2015 | Murphy | A41G 5/0046 132/201 |
| 2015/0223537 | A1* | 8/2015 | Kim | A41G 5/004 206/581 |
| 2016/0128408 | A1* | 5/2016 | Phillips | A41G 5/0046 132/201 |
| 2016/0206030 | A1 | 7/2016 | Yi | |
| 2016/0213083 | A1 | 7/2016 | Kim et al. | |
| 2016/0219958 | A1* | 8/2016 | Wang | A41G 5/004 |
| 2017/0127742 | A1 | 5/2017 | Riggins | |
| 2017/0202291 | A1 | 7/2017 | Kim et al. | |
| 2017/0224036 | A1* | 8/2017 | Kim | A41G 5/0046 |
| 2017/0251739 | A1 | 9/2017 | Kim et al. | |
| 2018/0199687 | A1* | 7/2018 | Ham | A45D 8/36 |
| 2018/0228236 | A1* | 8/2018 | Curbeon | A41G 5/0073 |
| 2019/0075870 | A1* | 3/2019 | Han | A41G 5/004 |
| 2019/0191803 | A1 | 6/2019 | Han | |

OTHER PUBLICATIONS https://www.amazon.com/Brazilian-Natural-Straight-Extension-Unprocessed/dp/B00F7QQHJA/ref-sr_1_3_a_it?ie-UTF8&qid=1546833123&sr=8-3&keywords=le+hair+virgin+brazilian+natural+straight+hair+weave; Reviewed on Amazon.com Aug. 30, 2015.

https://www.amazon.com/Extension-Extensions-Double-7pieces-105gram/dp/B01LZVVPDZ/ref-sr_1_2_a_it?ie=UTF8&quid-1546832408&sr-8-2-spons&keywods=18%2Binch%2BIN%2Bextensions%2Bhuman%Bhair&th=1; Reviewed by Amazon.com Dec. 6, 2016.

Photos of "Amy Collection Yaky Braid"; 3 views; unknown availability date to public but believed to be prior to filing of present application.

Photos of "Beauti Collection Platinum Yaki"; 3 views; unknown availability date to public but believed to be prior to filing of present application.

Photos of "Black Tide Professional Super Bulk Hair"; 3 views; unknown availability date to public but believed to be prior to filing of present application.

Photos of "Black Tide Professional Yaki Bulk Hair"; 3 views; unknown availability date to public but believed to be prior to filing of present application.

Photos of "Bobbie Boss Jumbo Braid"; 3 views; unknown availability date to public but believed to be prior to filing of present application.

Photos of "Epic Hot Water Braid"; 3 views; unknown availability date to public but believed to be prior to filing of present application.

Photos of "EZBraid Professional"; 3 views; unknown availability date to public but believed to be prior to filing of present application.

Photos of "Karizma Remi Yaki" Weave; 3 views; unknown availability date to public but believed to be prior to filing of present application.

Photos of "Linda U7" weave; 3 views; unknown availability date to public but believed to be prior to filing of present application.

Photos of "Que Jumbo Braid Premium Soft 2"; 3 views; unknown availability date to public but believed to be prior to filing of present application.

Photos of "Que Premium Soft Jumbo Braid"; 3 views; unknown availability date to public but believed to be prior to filing of present application.

Photos of "REMYTouch Interface Jumbo"; 3 views; unknown availability date to public but believed to be prior to filing of present application.

Photos of "Sensationnel Premium Wow" weave; 3 views; unknown availability date to public but believed to be prior to filing of present application.

Photos of "SuperLine Collection Silky Jumbo Braid"; 3 views; unknown availability date to public but believed to be prior to filing of present application.

Photos of "SuperLine Super Jumbo Braid"; 3 views; unknown availability date to public but believed to be prior to filing of present application.

Photos of "Urban Beauty Remi"; 3 views; unknown availability date to public but believed to be prior to filing of present application.

Photos of "Yaky Braid Femi"; 3 views; unknown availability date to public but believed to be prior to filing of present application.

Tsehaye, Rebecca , "NonFinal Office Action", U.S. Appl. No. 29/587,804, filed Dec. 15, 2016; dated May 22, 2019.

"Picture—Weaving Hair—Bottom", Photo of Weaving Hair; Bottom section: Unknown availability date but believed to be prior to filing of present application.

"Picture—Weaving Hair—Full Length", Photo of Weaving Hair; Full Length section: Unknown availability date but believed to be prior to filing of present application.

"Picture—Weaving Hair—Top", Photo of Weaving Hair; Top section: Unknown availability date but believed to be prior to filing of present application.

Raque, Samuel , "NonFinal Office Action", U.S. Appl. No. 15/853,844; filed Dec. 24, 2017; dated Mar. 20, 2020.

Thomas, Shane , "PCT Search Report", PCT Application No. PCT/US18/54482; filed Oct. 25, 2018; dated Dec. 14, 2018.

* cited by examiner

-- PRIOR ART --

SYNTHETIC BRAIDING HAIR OF DIFFERING LENGTHS PACKAGED WITH A CARDIOID

BACKGROUND

Technical Field

This disclosure relates generally to hair accessories, and more particularly to synthetic braiding hair.

Background Art

Hair accessories, including weaves and extensions, are becoming increasingly popular fashion accessories. Many people enjoy augmenting their natural hair with weaves, braids, or extensions.

Hair accessories generally come in two forms. In one form, human or synthetic hair is attached to a "weft." The weft is a natural or synthetic strip to which the hair is attached. The hair extends from a common side of the weft. When applying extensions using wefts of hair, the wefts are clipped, sewn, glued, or otherwise attached between rows of a person's natural hair to create stylistic effects, fashion effects, overall length, body, and so forth.

The second form is referred to as "braiding hair." Braiding hair is loose strands of synthetic hair that are bundled together and sold in a package. Rather than clipping, sewing, or gluing a weft to the wearer's head, with braiding hair the loose strands are braided into strands of the wearer's own hair much in the same way fibers are braided together to form a rope. The addition of the loose strands creates a lengthening effect as well as adding body to the wearer's own hair.

People using braiding hair are frequently discerning customers. They desire a natural look, and seldom wish to appear as if some mechanized process has been applied to their hair. It would be advantageous to have an improved braiding hair product and corresponding packaging to more readily meet these discerning customer needs.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present disclosure.

Figure 1:
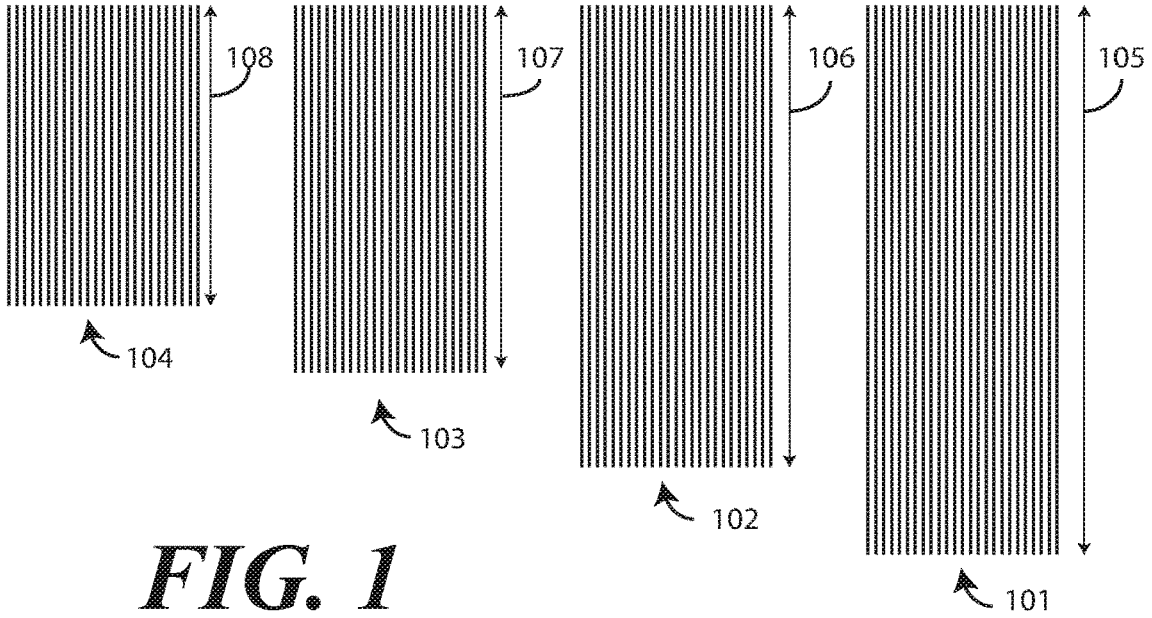
FIG. 1 illustrates braiding hair having different lengths in accordance with one or more embodiments of the disclosure.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

DETAILED DESCRIPTION OF THE DRAWINGS

Embodiments of the disclosure are now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on." Relational terms such as first and second, top and bottom, and the like may be used solely to distinguish one entity or action from another entity or action without necessarily requiring or implying any actual such relationship or order between such entities or actions. The terms "substantially" and "about" are used to refer to dimensions, orientations, or alignments inclusive of manufacturing tolerances. Thus, a "substantially orthogonal" angle with a manufacturing tolerance of plus or minus two degrees would include all angles between 88 and 92, inclusive. Also, reference designators shown herein in parenthesis indicate components shown in a figure other than the one in discussion. For example, talking about a device (10) while discussing figure A would refer to an element, 10, shown in figure other than figure A.

Figure 10:
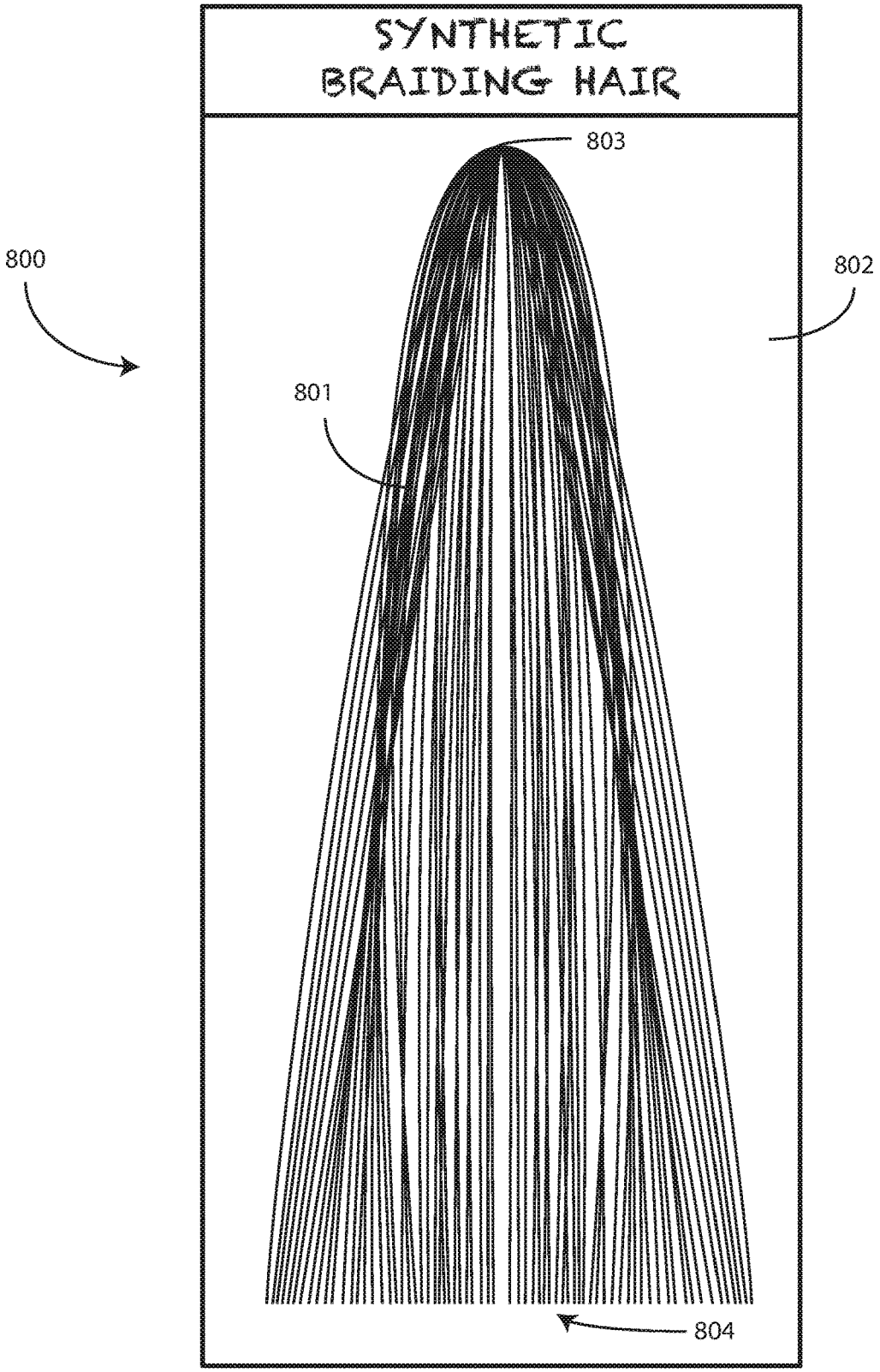
FIG. 10 illustrates prior art braiding hair.

Turning now to FIG. 10, illustrated therein is a prior art package 1000 of braiding hair 1001. A piece of cardboard 1002 supports the braiding hair 1001 with a twist tie 1003. As shown in this figure, each strand of the braiding hair 1001 has exactly the same length. Accordingly, the base 1004 of the braiding hair 1001 is substantially flat. While slightly exaggerated in the drawing to clearly illustrate the substantially flat bottom with an image that will be reproducible in a published patent document, in practice the base 1004 of the braiding hair 1001, when bundled, appears substantially flat due to the fact that each strand of the braiding hair 1001 has exactly the same length.

The reason that the base 1004 of the braiding hair 1001 is substantially flat is due to the manufacturing process. When the strands of braiding hair 1001 are manufactured, such as by spinning, extrusion, or other techniques, the fibers are all cut to a single length. This saves time and cost during manufacture and allows groups of strands to be cut simultaneously.

The problem with each strand of the braiding hair 1001 having the same length is that this constitutes an unnatural look. Consequently, hair stylists must "tease" the strands of braiding hair 1001 in their hands to pull the ends of some strands back into their hand so that the ends of the braiding hair 1001, i.e., the base 1004, has a more natural look by being uneven. This is tedious and takes a tremendous amount of time. This teasing process must occur before the strands of braiding hair 1001 can be used.

Embodiments of the disclosure provide a solution that eliminates the need to manually tease braiding hair prior to use. To wit, in one or more embodiments, a plurality of bundles of braiding hair strands, each having a different length, are bundled together. For example, in one embodiment a first bundle of synthetic hair strands having a first length are bundled with a second bundle of synthetic hair strands having a second length that is shorter than the first length. Additional bundles can be added as well. For instance, a third bundle of synthetic hair strands having a third length that is shorter than the second length can be included with the first bundle and the second bundle. Similarly, a fourth bundle of synthetic hair strands having a fourth length that is shorter than the third length can be bundled with the first, second, and third bundles, and so forth.

Once the bundled synthetic braiding hair is created, in one embodiment a binder, such as an elastic band, is coupled about a waist of the bundled synthetic braiding hair. The bundled synthetic braiding hair can then be folded about the binder. When this occurs, the outer perimeter of the folded bundled synthetic braiding hair defines, in one embodiment, a substantially cardioid shaped perimeter. More specifically, the side of the substantially cardioid shaped perimeter opposite a cusp side of the substantially cardioid shaped perimeter is rounded due to the fact that each sub-bundle of the bundled synthetic braiding hair has different lengths. This serves as a mnemonic device to inform a user that no teasing is necessary because the strands in the bundled synthetic braiding hair are all of different lengths, advantageously, providing for a more natural and beautiful appearance.

Turning to FIG. 1, illustrated therein are four bundles of synthetic braiding hair. Each bundle comprises a plurality of synthetic hair strands. As shown, there is a first bundle 101 of synthetic braiding hair strands, a second bundle 102 of synthetic braiding hair strands, a third bundle 103 of synthetic braiding hair strands, and a fourth bundle 104 of synthetic braiding hair strands. As will be described in more detail below, the four bundles of synthetic braiding hair can be bundled together to create bundled synthetic braiding hair. It should be noted that while four bundles of synthetic braiding hair are shown for ease of illustration in FIG. 1, bundled synthetic braiding hair assemblies configured in accordance with embodiments of the disclosure can have fewer than four bundles or more than four bundles as well.

The synthetic strands in each bundle have a corresponding length. For example, the first bundle 101 of synthetic hair strands has a first length 105, while the second bundle 102 of synthetic hair strands has a second length 106. Similarly, the third bundle 103 of synthetic hair strands has a third length 107, while the fourth bundle 104 of synthetic hair strands has a fourth length 108. In one or more embodiments, each synthetic strand in each bundle has a common length, but this common length is different from the lengths of synthetic strands in other bundles. For instance, all the synthetic strands in the first bundle 101 can have substantially a common length, which is the first length 105. However, these synthetic strands will have different lengths when compared to synthetic strands in the second bundle 102, the third bundle 103, the fourth bundle 104, and so forth.

In one or more embodiments, the length of each bundle of synthetic strands is different from the others. In this illustrative embodiment, the first length 105 of the first bundle 101 of synthetic hair strands is longer than the second length 106 of the second bundle 102 of synthetic hair strands. Said differently, the second bundle 102 of synthetic hair synthetic hair strands has a second length 106 that is shorter than the first length 105. Similarly, the third bundle 103 of synthetic hair strands has a third length 107 that is shorter than the second length 106, while the fourth bundle 104 of synthetic hair strands has a fourth length 108 that is shorter than the third length 107.

The first length 105, the second length 106, the third length 107, and the fourth length 108 can be any of a number of lengths. In one embodiment, the first length 105 is one of sixty inches, fifty inches, forty inches, and thirty inches. Said differently, in one embodiment the first length 105 is selected from the group consisting of sixty inches, fifty inches, forty inches, and thirty inches.

In one or more embodiments, each subsequent length is then two inches shorter than the former. Thus, in one or more embodiments, the second length 106 is two inches shorter than the first length 105. Similarly, the third length 107 is two inches shorter than the second length 106, and the fourth length 108 is two inches shorter than the third length 107. This difference between the first length 105, the second length 106, the third length 107, and the fourth length 108 is illustrative only, as other differences that are greater than, or shorter than, two inches will be obvious to those of ordinary skill in the art having the benefit of this disclosure.

For example, in one embodiment where the first length 105 is sixty inches, the second length 106 is fifty-eight inches, the third length 107 is fifty-six inches, and the fourth length 108 is fifty-four inches. In another embodiment where the first length 105 is fifty inches, the second length 106 is forty-eight inches, the third length 107 is forty-six inches, and the fourth length 108 is forty-four inches. In another embodiment where the first length 105 is forty inches, the second length 106 is thirty-eight inches, the third length 107 is thirty-six inches, and the fourth length 108 is thirty-four inches. These dimensions are illustrative only, as others will be obvious to those of ordinary skill in the art having the benefit of this disclosure.

Figure 2:
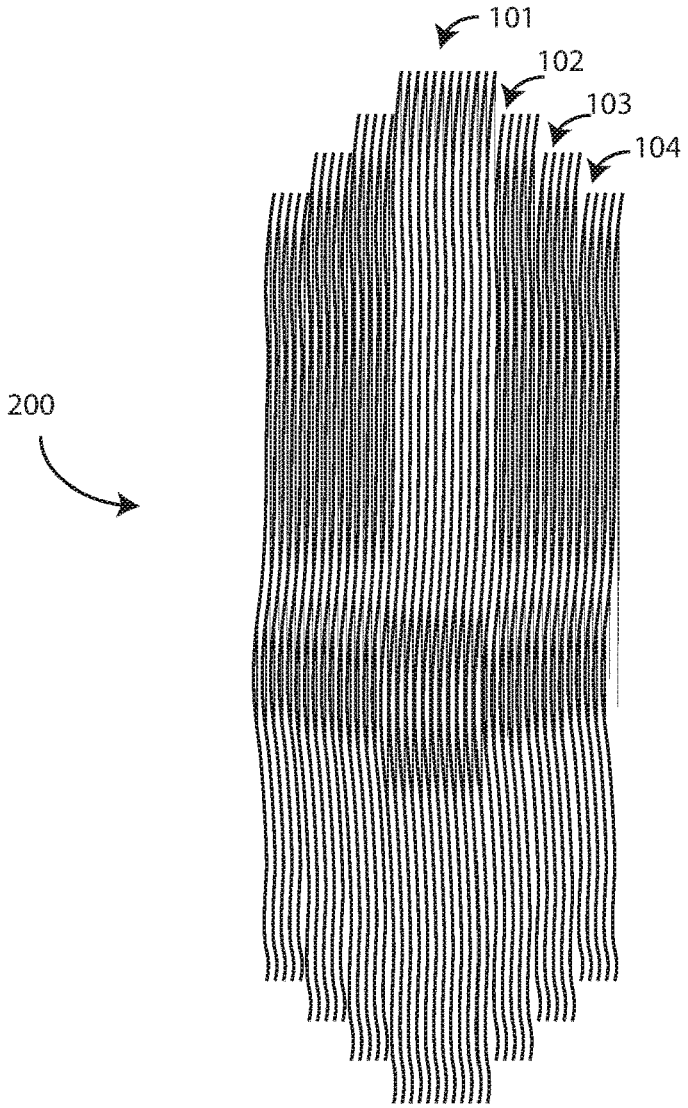
FIG. 2 illustrates braiding hair having different lengths being bundled in accordance with one or more embodiments of the disclosure.

Turning now to FIG. 2, the first bundle 101 of synthetic hair strands, the second bundle 102 of synthetic hair strands, the third bundle 103 of synthetic hair strands, and the fourth bundle 104 of synthetic hair strands are assembled together to form a braiding hair assembly 200. In one or more embodiments, this braiding hair assembly 200 can be "hackled," which involves pulling the bundles of hair strands through a bed of metal or plastic spikes. The friction between the strands of hair and the spikes functions as a comb, effectively evenly distributing the various hair strands throughout the braiding hair assembly 200. Once the braiding hair assembly 200 is bundled together, and optionally hackled, thereby distributing strands from the first bundle 101 of synthetic hair strands, the second bundle 102 of synthetic hair strands, the third bundle 103 of synthetic hair strands, and the fourth bundle 104 of synthetic hair strands evenly across the braiding hair assembly 200, a bundled synthetic braiding hair accessory is formed, one example of which is shown in FIG. 3.

Figure 3:
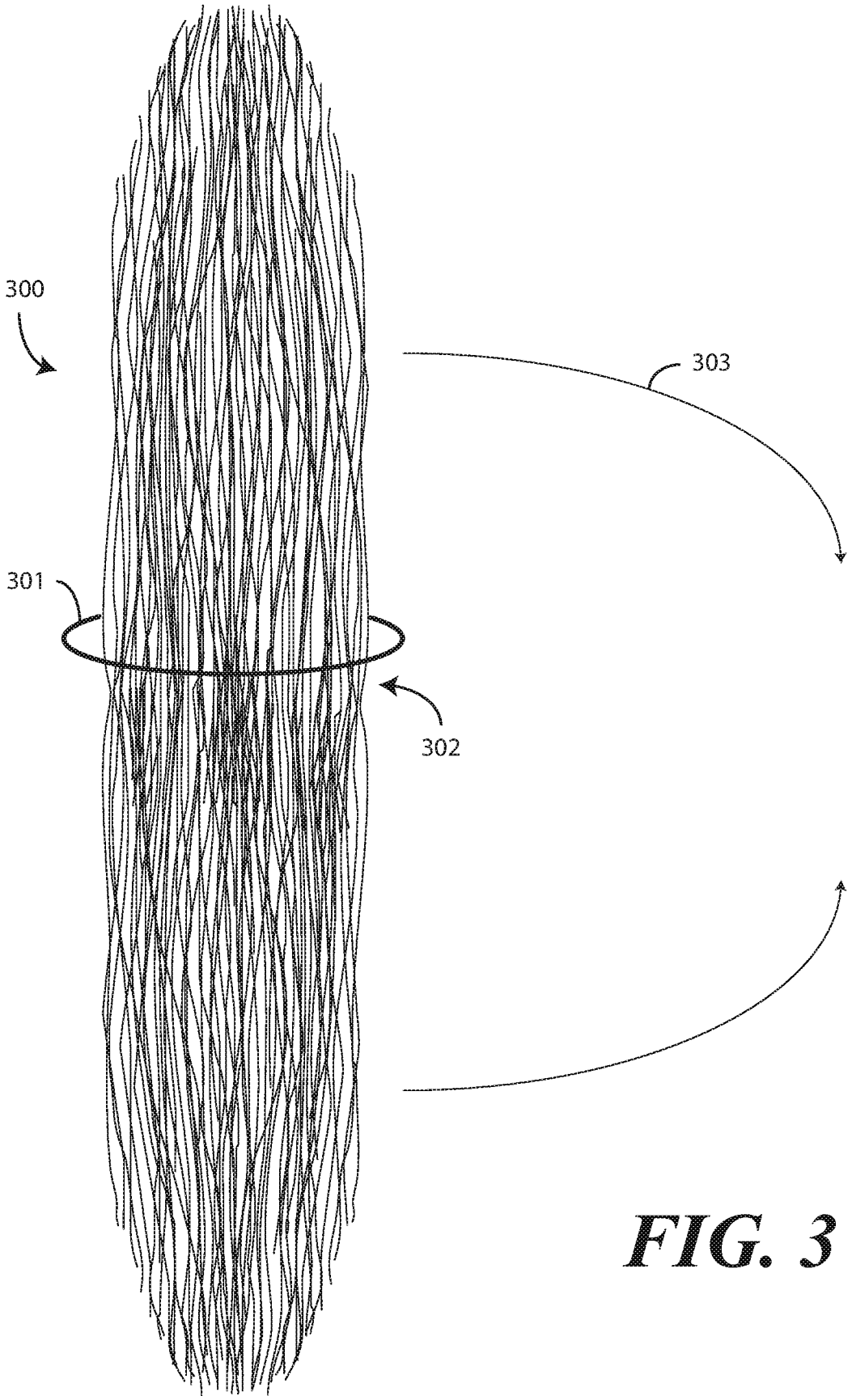
FIG. 3 illustrates bundled braiding hair being bound and folded in accordance with one or more embodiments of the disclosure.

Turning now to FIG. 3, illustrated therein is bundled synthetic braiding hair 300 comprising at least the first bundle (101) of synthetic hair strands, the second bundle (102) of synthetic hair strands, the third bundle (103) of synthetic hair strands, and the fourth bundle (104) of synthetic hair strands. Once the bundled synthetic braiding hair 300 is formed a binder 301 can be coupled about a waist 302 of the bundled synthetic braiding hair 300. The binder 301 can be an elastic band, a rubber band, a zip-strip, a twist tie, or a plastic strip. Other examples of binders will be obvious to those of ordinary skill in the art having the benefit of this disclosure.

In one or more embodiments, the bundled synthetic braiding hair 300 is then folded 303 about the waist 302. In one embodiment, the bundled synthetic braiding hair 300 is folded 303 about the waist 302 after the binder 301 is coupled about the waist 302. In other embodiments, the bundled synthetic braiding hair 300 is folded 303 about the waist 302 prior to coupling the binder 301 about the waist 302. The resulting folded bundled synthetic braiding hair is shown in FIG. 4.

Figure 4:
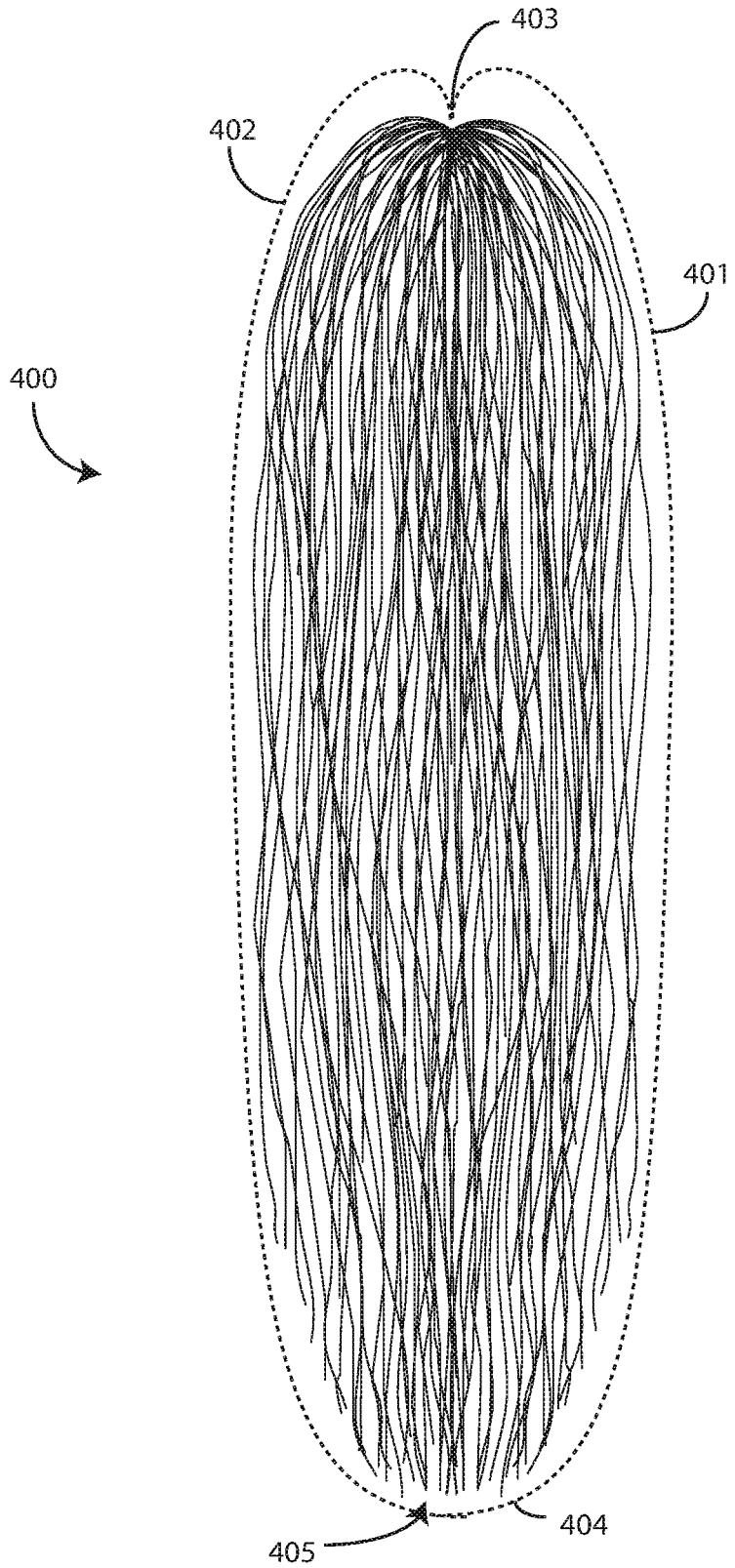
FIG. 4 illustrates bound, bundled, and folded braiding hair in accordance with one or more embodiments of the disclosure.

As shown in FIG. 4, the folded bundled synthetic braiding hair 400 defines a substantially cardioid shaped perimeter 401. The term "substantially" is used because while the substantially cardioid shaped perimeter 401 is not a perfect cardioid as would be the case when a circle of fixed radius is rotated about another circle with a point at the intersection of the fixed radius drawing the cardioid, it has a cardioid appearance in that it includes a cusp 403 and two cardioidal lobes. The substantially cardioid shaped perimeter 401 also resembles an inverted teardrop with a rounded end instead of a pointed one.

In this illustrative embodiment, the substantially cardioid shaped perimeter 401 has a first side 402 with a cusp 403 and a second side 404, which is disposed opposite the first side 402 having the cusp 403. In one or more embodiments, the second side 404 is rounded due to the fact that the synthetic strands in each of the first bundle (101) of synthetic hair strands, the second bundle (102) of synthetic hair strands, the third bundle (103) of synthetic hair strands, and the fourth bundle (104) of synthetic hair strands have different lengths. Thus, in contrast to the prior art package (800) of braiding hair (801), which had a base (804) of the braiding hair (801) that was substantially flat, in embodiments of the disclosure the base 405 of the folded bundled synthetic braiding hair 400 is rounded. This serves as a mnemonic device to inform a user that no teasing before use is required because the strands in the bundled synthetic braiding hair are all of different lengths. This advantageously saves time and effort for the technician, while providing a more natural and beautiful appearance for the end user.

Figure 5:
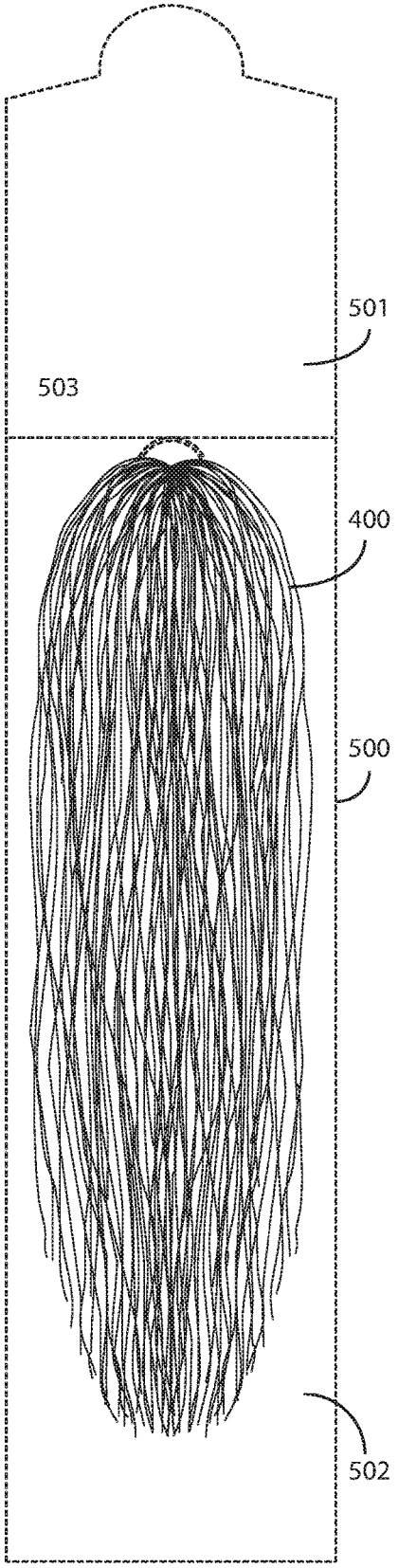
FIG. 5 illustrates bound, bundled, and folded braiding hair attached to a package in accordance with one or more embodiments of the disclosure.

Turning now to FIG. 5, illustrated therein is the folded bundled synthetic braiding hair 400 with a backer panel 500. The backer panel 500 can be manufactured from cardboard, plastic, paper, or other materials. The backer panel 500 can be opaque, translucent, or transparent. In this illustrative embodiment, the binder 301 is coupled to the backer panel 500.

In this illustrative embodiment, the backer panel 500 includes a first portion 501 and a second portion 502. The first portion 501 and the second portion 502 intersect at a fold line 503 in one embodiment. The first portion 501 can fold relative to the second portion 502 about the fold line 503 so as to at least partially cover the folded bundled synthetic braiding hair 400.

Figure 6:
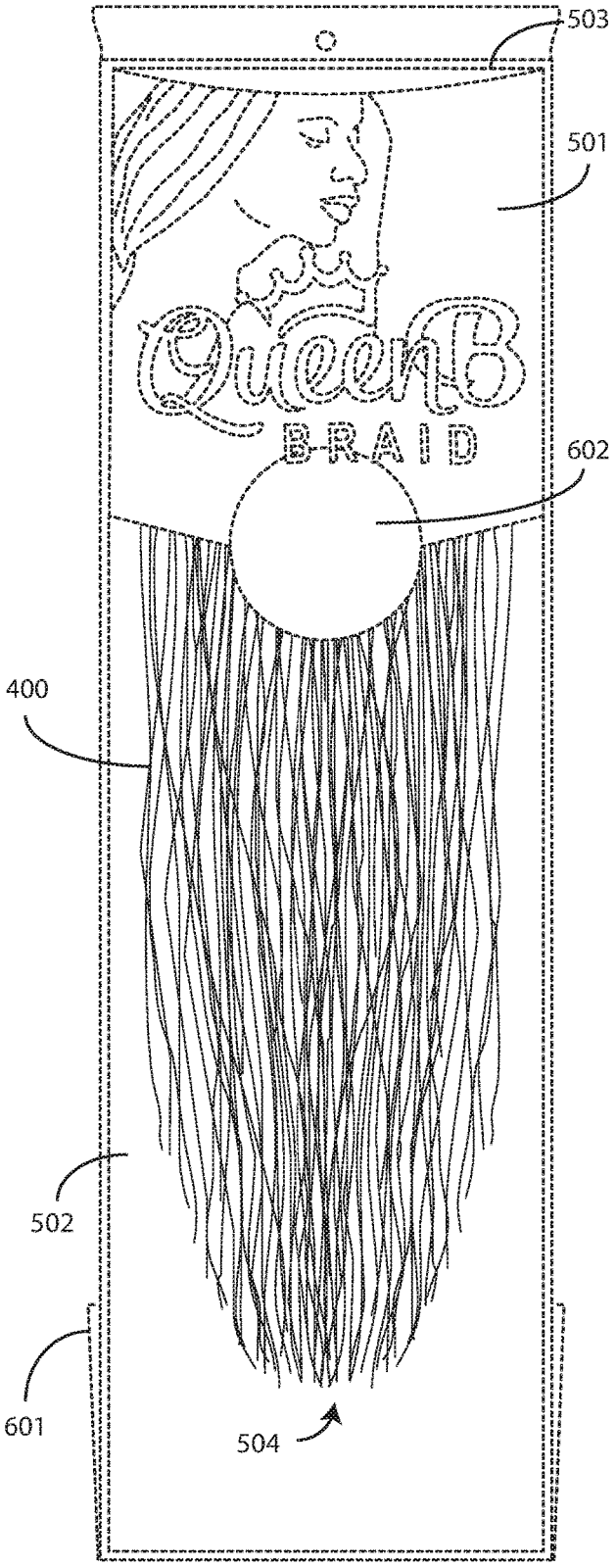
FIG. 6 illustrates packaged braiding hair in accordance with one or more embodiments of the disclosure.

Turning now to FIG. 6, in one embodiment the second portion 502 is longer than the folded bundled synthetic braiding hair 400, while the first portion 501 is shorter than the folded bundled synthetic braiding hair 400. Accordingly, when the first portion 501 is folded about the fold line 503 relative to the second portion, the second portion 502 completely spans a first side (oriented into the page) of the folded bundled synthetic braiding hair 400, while the first portion 501 only partially spans a second side (oriented out of the page) of the folded bundled synthetic braiding hair 400. When this occurs, a rounded side 504 of the substantially cardioid shaped perimeter (401) of the folded bundled synthetic braiding hair 400 is visible. Said differently, as shown in FIG. 6, a rounded side 504 of the substantially cardioid shaped perimeter (401) disposed opposite a cusp side, e.g. the first side (401) of the of the substantially cardioid shaped perimeter 401, is exposed beneath the first portion 501 of the backer panel 500 partially spanning the second side of the folded bundled synthetic braiding hair 400.

A container 601 can then be disposed about the backer panel 500 and the folded bundled synthetic braiding hair 400. The completed assembly is now ready for sale to a consumer. Advantageously, the consumer can readily identify the fact that the folded bundled synthetic braiding hair 400 includes hair of different lengths, and thus requires no teasing prior to use, due to the exposure of the a rounded side 504 of the substantially cardioid shaped perimeter 401 of the folded bundled synthetic braiding hair 400 beneath the first portion 501 of the backer panel 500.

In one or more embodiments, a length of the longest strand is indicated on a length medallion 602. Accordingly, the consumer can determine the length of the longest strand, e.g., 60", by reading the length medallion 602 to make an informed and educated purchase.

Figure 7:
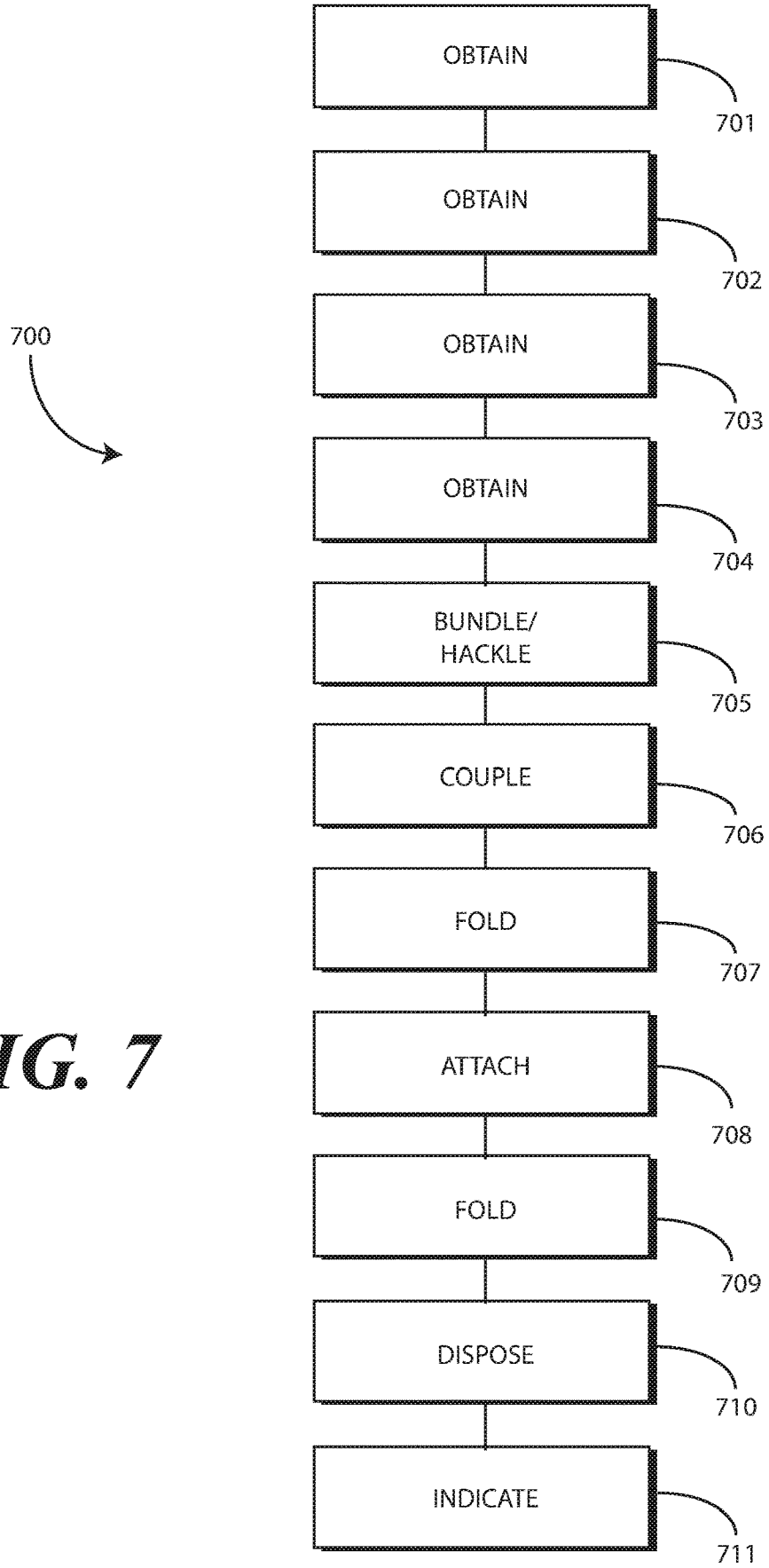
FIG. 7 illustrates one explanatory method in accordance with one or more embodiments of the disclosure.

Turning now to FIG. 7, illustrated therein is one method 700 in accordance with one or more embodiments of the disclosure. Beginning at step 701, the method 700 includes obtaining a first bundle of synthetic hair stands having a first length. At step 702, the method 700 includes obtaining a second bundle of synthetic hair strands having a second length that is shorter than the first length.

At optional step 703, the method 700 includes obtaining a third bundle of synthetic hair strands having a third length that is shorter than the second length. At optional step 704, the method 700 includes obtaining a fourth bundle of synthetic hair strands having a fourth length that is shorter than the third length. Additional bundles beyond the fourth bundle can optionally be obtained as well.

At step 705, the method 700 includes bundling the first bundle and the second bundle to form bundled synthetic braiding hair. In one or more embodiments, step 705 further comprises hackling the first bundle and the second bundle as noted above. Where step 703 is included, the bundling of step 705 comprises bundling the third bundle with the first bundle and the second bundle. Where step 704 is includes, the bundling of step 705 comprises bundling the fourth bundle with the first bundle and the second bundle and the third bundle. Where additional bundles are included, they can be bundled with the others at step 705 as well. Where step 703 includes bundling one or more of the third bundle and the fourth bundle, step 705 can include hackling these bundles as well.

At step 706, the method 700 optionally comprises coupling a binder about a waist of the bundled synthetic braiding hair. At step 707, the method 700 includes folding the bundled synthetic braiding hair about the binder to define a substantially cardioid shaped perimeter.

At optional step 708, the method 700 includes attaching the binder to a backer panel. At optional step 709, the method 700 includes folding the backer panel about the binder so that a first portion of the backer panel completely spans a first side of the bundled synthetic braiding hair and a second portion of the backer panel partially spans a second side of the bundled synthetic braiding hair.

At optional step 710, the method 700 includes disposing the backer panel in a package. In one embodiment, this disposition is such that a rounded side of the substantially cardioid shaped perimeter disposed opposite a cusp side of the substantially cardioid shaped perimeter is exposed beneath the second portion of the backer panel. At optional step 711, the method 700 can include indicating the first length on the second portion of the backer panel.

Figure 8:
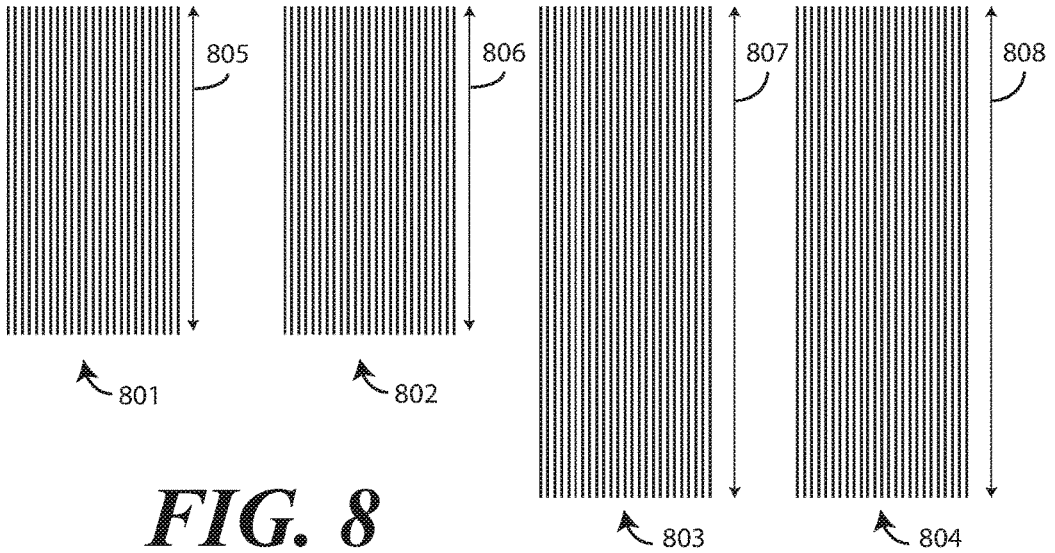
FIG. 8 illustrates braiding hair having different lengths in accordance with one or more embodiments of the disclosure.
Figure 9:
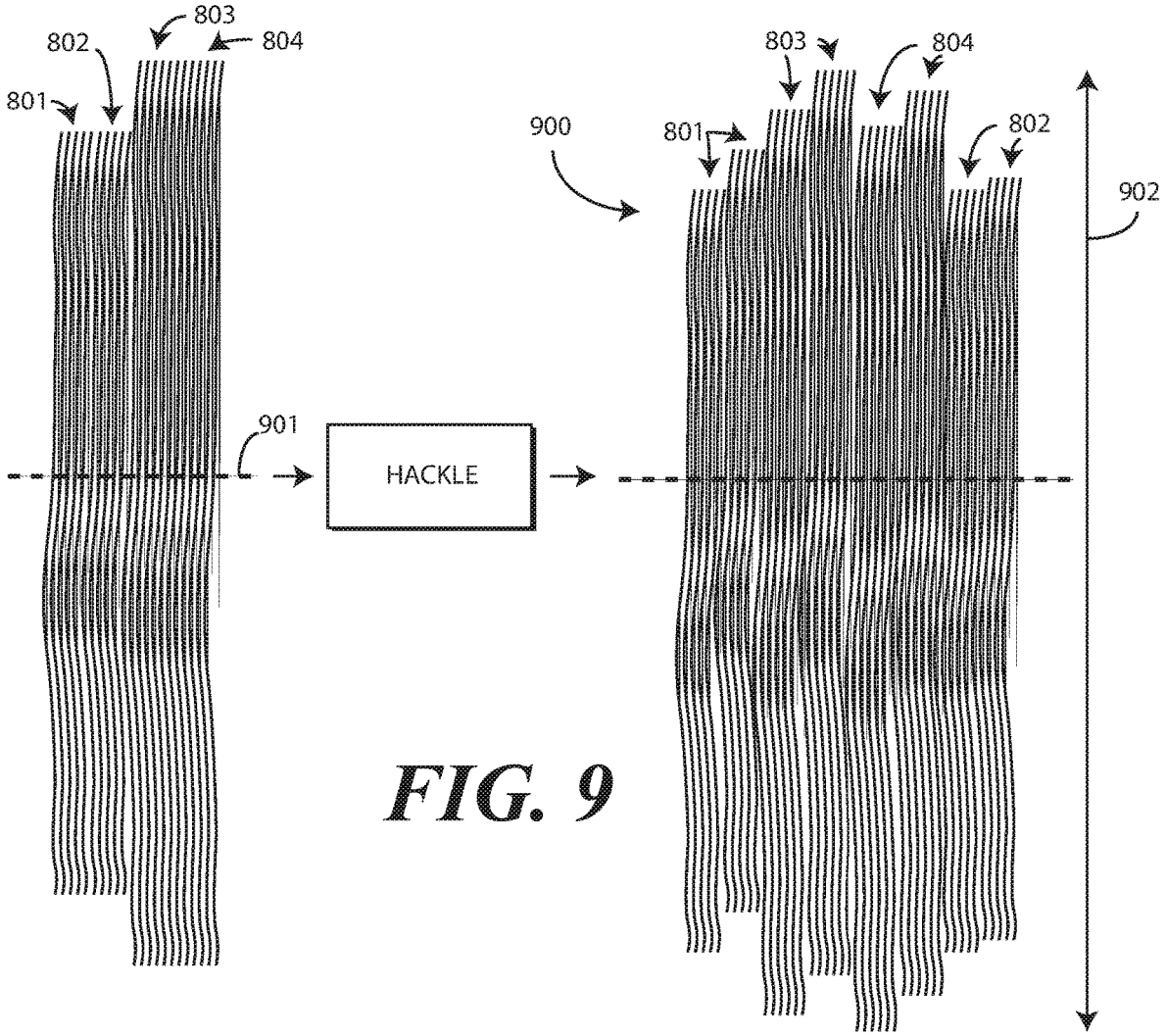
FIG. 9 illustrates braiding hair having different lengths being bundled in accordance with one or more embodiments of the disclosure.

Turning now to FIG. 8, illustrated therein are four bundles of synthetic braiding hair. Each bundle comprises a plurality of synthetic hair strands. As shown, there is a first bundle 801 of synthetic braiding hair strands, a second bundle 802 of synthetic braiding hair strands, a third bundle 803 of synthetic braiding hair strands, and a fourth bundle 804 of synthetic braiding hair strands. While four bundles of synthetic braiding hair are shown in this illustrative embodiment, bundled synthetic braiding hair assemblies configured in accordance with embodiments of the disclosure can have fewer than four bundles or more than four bundles as well. For example, in one embodiment a bundled synthetic braiding hair assembly includes only the first bundle 801 and the third bundle 803. In another embodiment, two bundles of each of the first bundle 801, the second bundle 802, the third bundle 903, and the fourth bundle 904 can be used. Other combinations will be obvious to those of ordinary skill in the art having the benefit if this disclosure.

In this illustrative embodiment, the synthetic strands in each bundle have a corresponding length. For example, the first bundle 801 of synthetic hair strands has a first length 805, while the second bundle 802 of synthetic hair strands has a second length 806. Similarly, the third bundle 803 of synthetic hair strands has a third length 807, while the fourth bundle 804 of synthetic hair strands has a fourth length 808. In one or more embodiments, each synthetic strand in each bundle has a common length, but this common length is different from the lengths of synthetic strands in at least one other bundle. However, in this illustrative embodiment the first bundle 801 and the second bundle 802 have a common length, while the third bundle 803 and the fourth bundle 804 also have a common length that is different from the common length of the first bundle 801 and the second bundle 802.

For instance, in this embodiment all the synthetic strands in the first bundle 801 can have substantially a common length, which is the first length 805. Similarly, all the strands in the second bundle 802 have substantially a common length, which is the second length 806. In this embodiment, the first length 805 and the second length 806 are substantially the same.

Similarly, all the synthetic strands in the third bundle 803 can have substantially a common length, which is the third length 807. All the strands in the fourth bundle 803 have substantially a common length, which is the fourth length 808. In this embodiment, the third length 807 and the fourth length 808 are substantially the same. However, in this illustrative embodiment the first length 805 and the second length 806 is different when compared to synthetic strands in the third bundle 803 and the fourth bundle 804.

In one or more embodiments, the length of at least two bundles of synthetic strands is different from the length of at least two other bundles. In this illustrative embodiment, the first length 805 of the first bundle 801, and the second length 806 of the second bundle 802 of synthetic hair strands are shorter than the third length 807 of the third bundle 803 of synthetic hair strands and the fourth length 808 of the fourth bundle 804. Said differently, the common length defined by the first length 805 and the second length 806 is shorter than the common length defined by the third length 807 and the fourth length 808.

The first length 805, the second length 806, the third length 807, and the fourth length 808 can be any of a number of lengths. In one embodiment, where the resulting braiding hair assembly formed by the bundles is desired to have a maximum length of thirty inches, the first length 805 and the second length 806 are seventeen inches. In one embodiment, where the resulting braiding hair assembly formed by the bundles is desired to have a maximum length of thirty inches, the third length 807 and the fourth length 808 are one of twenty-five inches or twenty-six inches.

In one embodiment, where the resulting braiding hair assembly formed by the bundles is desired to have a maximum length of forty inches, the first length 805 and the second length 806 are twenty-six inches. In one embodiment, where the resulting braiding hair assembly formed by the bundles is desired to have a maximum length of forty inches, the third length 807 and the fourth length 808 are thirty-five inches.

In one embodiment, where the resulting braiding hair assembly formed by the bundles is desired to have a maximum length of fifty inches, the first length 805 and the second length 806 are thirty-four inches. In one embodiment, where the resulting braiding hair assembly formed by the bundles is desired to have a maximum length of fifty inches, the third length 807 and the fourth length 808 are forty-three inches.

In one embodiment, where the resulting braiding hair assembly formed by the bundles is desired to have a maximum length of sixty inches, the first length 805 and the second length 806 are forty-three inches. In one embodiment, where the resulting braiding hair assembly formed by the bundles is desired to have a maximum length of forty inches, the third length 807 and the fourth length 808 are fifty-two inches.

In one or more embodiments, therefore, the common length defined by the first length 805 and the second length 806 is between eight inches and ten inches shorter than the common length defined by the third length 807 and the fourth length 808. For example, in one embodiment the common length defined by the first length 805 and the second length 806 is nine inches shorter than the common length defined by the third length 807 and the fourth length 808. This difference between the common length defined by the first length 805 and the second length 806 and the common length defined by the third length 807 and the fourth length 808 is illustrative only, as other differences that are greater than ten inches, or shorter than eight inches, inches will be obvious to those of ordinary skill in the art having the benefit of this disclosure.

Turning now to FIG. 2, the first bundle 801 of synthetic hair strands, the second bundle 802 of synthetic hair strands, the third bundle 803 of synthetic hair strands, and the fourth bundle 804 of synthetic hair strands are assembled together with a common central axis 901 to form a braiding hair assembly 900. The braiding hair assembly 900 is then hackled, thereby distributing strands from the first bundle 801 of synthetic hair strands, the second bundle 802 of synthetic hair strands, the third bundle 803 of synthetic hair strands, and the fourth bundle 804 of synthetic hair strands evenly, in two dimensions (length and width) across the braiding hair assembly 900. This results in a bundled synthetic braiding hair accessory 903 is formed.

In one or more embodiments, the length 902 of the bundled synthetic braiding accessory 903 is longer than any of the first length (805), the second length (806), the third length (807), or the fourth length (808). For example, in one embodiment where the first length (805) and the second length (806) are seventeen inches, and the third length (807) and the fourth length (808) are twenty-six inches, the length 902 of the bundled synthetic braiding hair accessory 903 is thirty inches after hackling. In another embodiment where the first length (805) and the second length (806) are twenty-six inches, and the third length (807) and the fourth length (808) are thirty-five inches, the length 902 of the bundled synthetic braiding hair accessory 903 is forty inches after hackling.

In another embodiment where the first length (805) and the second length (806) are thirty-four inches, and the third length (807) and the fourth length (808) are forty-three inches, the length 902 of the bundled synthetic braiding hair accessory 903 is fifty inches after hackling. In another embodiment where the first length (805) and the second length (806) are forty-three inches, and the third length (807) and the fourth length (808) are fifty-two inches, the length 902 of the bundled synthetic braiding hair accessory 903 is sixty inches after hackling. As noted, other dimensions for the bundles and resulting lengths of the bundled synthetic braiding hair accessory 903 will be obvious to those of ordinary skill in the art having the benefit of this disclosure. Additionally, the amount of hackling occurring can vary the length 902 of the bundled synthetic braiding hair accessory 903. Once the bundled synthetic braiding hair accessory 903 is formed, it can be folded and packaged as described above with reference to FIGS. 3-6.

In the foregoing specification, specific embodiments of the present disclosure have been described. However, one of ordinary skill in the art appreciates that various modifications and changes can be made without departing from the scope of the present disclosure as set forth in the claims below. Thus, while preferred embodiments of the disclosure have been illustrated and described, it is clear that the disclosure is not so limited. Numerous modifications, changes, variations, substitutions, and equivalents will occur to those skilled in the art without departing from the spirit and scope of the present disclosure as defined by the following claims. Accordingly, the specification and figures are to be regarded in an illustrative rather than a restrictive sense, and all such modifications are intended to be included within the scope of present disclosure. The benefits, advantages, solutions to problems, and any element(s) that may cause any benefit, advantage, or solution to occur or become more pronounced are not to be construed as a critical, required, or essential features or elements of any or all the claims.

What is claimed is:

1. A hair accessory, comprising:

bundled synthetic braiding hair, comprising:

a first bundle of synthetic hair strands having a first length; and a second bundle of synthetic hair strands having a second length that is shorter than the first length; and a binder coupled about a waist of the bundled synthetic braiding hair;

wherein the bundled synthetic braiding hair is folded about the binder to define a substantially cardioid shaped perimeter;

further comprising a backer panel, wherein the binder is coupled to the backer panel, wherein the backer panel is folded, thereby completely spanning a first side of the bundled synthetic braiding hair and partially spanning a second side of the bundled synthetic braiding hair.

2. The hair accessory of claim 1, the bundled synthetic braiding hair further comprising a third bundle of synthetic hair strands having a third length that is shorter than the second length.

3. The hair accessory of claim 2, the bundled synthetic braiding hair further comprising a fourth bundle of synthetic hair strands having a fourth length that is shorter than the third length.

4. The hair accessory of claim 3, wherein the first length is selected from the group consisting of sixty inches, fifty inches, forty inches, and thirty inches.

5. The hair accessory of claim 4, wherein the second length is two inches shorter than the first length.

6. The hair accessory of claim 5, wherein the third length is two inches shorter than the second length and the fourth length is two inches shorter than the third length.

7. The hair accessory of claim 1, the bundled synthetic braiding hair further comprising a third bundle of synthetic hair strands having the first length and a fourth bundle of synthetic hair strands having the second length.

8. The hair accessory of claim 7, wherein the second length is between eight inches and ten inches shorter than the first length, and wherein the bundled synthetic braiding hair has a length that is greater than the first length or the second length.

9. The hair accessory of claim 1, the substantially cardioid shaped perimeter comprising a rounded side and a cusp side.

10. The hair accessory of claim 9, further comprising a container disposed about the backer panel and the bundled synthetic braiding hair.

11. The hair accessory if claim 1, wherein a rounded side of the substantially cardioid shaped perimeter opposite a cusp side of the substantially cardioid shaped perimeter is exposed beneath a portion of the backer panel partially spanning the second side of the bundled synthetic braiding hair.

12. A method of packaging a hair accessory, comprising:

obtaining a first bundle of synthetic hair strands having a first length;

obtaining a second bundle of synthetic hair strands having a second length that is shorter than the first length;

bundling the first bundle and the second bundle to form bundled synthetic braiding hair;

coupling a binder about a waist of the bundled synthetic braiding hair;

folding the bundled synthetic braiding hair about the binder to define a substantially cardioid shaped perimeter;

attaching the binder to a backer panel; and folding the backer panel about the binder so that a first portion of the backer panel completely spans a first side of the bundled synthetic braiding hair and a second portion of the backer panel partially spans a second side of the bundled synthetic braiding hair.

13. The method of claim 12, further comprising obtaining:

a third bundle of synthetic hair strands having a third length that is shorter than the second length; and a fourth bundle of synthetic hair strands having a fourth length that is shorter than the third length;

wherein the bundling comprises:

bundling the third bundle with the first bundle and the second bundle; and bundling the fourth bundle with the first bundle and the second bundle and the third bundle.

14. The method of claim 12, further comprising obtaining:

a third bundle of synthetic hair strands having the first length; and a fourth bundle of synthetic hair strands having the second length;

wherein the bundling comprises:

bundling the third bundle with the first bundle and the second bundle; and bundling the fourth bundle with the first bundle and the second bundle and the third bundle.

15. The method of claim 12, further comprising disposing a container about the the backer panel.

16. The method of claim 15, further comprising indicating a length of a longest strand of the bundled synthetic braiding hair on a medallion of the backer panel.

17. The method of claim 12, further comprising disposing the backer panel in a package such that a rounded side of the substantially cardioid shaped perimeter disposed opposite a cusp side of the substantially cardioid shaped perimeter is exposed beneath the second portion of the backer panel.

18. The method of claim 17, further comprising indicating the first length on the second portion of the backer panel.

19. The method of claim 17, further comprising hackling the bundled synthetic braiding hair to obtain a length of the bundled synthetic braiding that is longer than either of the first length or the second length.

20. The method of claim 19, further comprising indicating the length of the bundled synthetic braiding hair on the second portion of the backer panel.

* * * * *